United States Patent [19]

Metcalf

[11] Patent Number: 5,028,022

[45] Date of Patent: Jul. 2, 1991

[54] TRASH BAG SECUREMENT METHOD AND DEVICE

[76] Inventor: James C. Metcalf, 254 Dianna Dr., Lumberton, Tex. 77711

[21] Appl. No.: 470,362

[22] Filed: Jan. 25, 1990

[51] Int. Cl.[5] ..... B65B 67/00

[52] U.S. Cl. ..... 248/95; 220/404; 248/101

[58] Field of Search ..... 248/95, 97, 98, 99, 248/100, 101; 220/404

[56] References Cited

U.S. PATENT DOCUMENTS

| | | | |
|---|---|---|---|
| 1,608,901 | 11/1926 | Miller | 220/404 |
| 1,955,385 | 4/1934 | Gray | 220/404 |
| 2,159,192 | 5/1939 | Werdin | 220/404 |
| 2,430,155 | 11/1947 | Buttery | 248/95 X |
| 2,580,942 | 1/1952 | Murad et al. | 220/404 |
| 3,148,799 | 9/1964 | Meroney | 220/404 |
| 3,916,962 | 11/1975 | Stolt . | |
| 4,488,697 | 12/1984 | Garvey . | |
| 4,715,572 | 12/1987 | Robbins, III et al. . | |
| 4,757,966 | 7/1988 | Uamris . | |
| 4,765,579 | 8/1988 | Robbins, IIII et al. | 248/101 |

*Primary Examiner*—David L. Talbott
*Attorney, Agent, or Firm*—Leon Gilden

[57] ABSTRACT

A trash bag securement device includes a continuous loop member defined by a planar body wall, with a scalloped top edge and a planar continuous bottom edge. The top edge includes downwardly depending grasping fingers formed with an arcuate upper surface and a planar lower surface. The fingers taper and narrow from the top edge to their free forward terminal end to grasp and secure a trash bag liner between an interior wall of a trash can and the free end of the fingers. The liner is preferably formed of flexible memory retentent materials.

1 Claim, 4 Drawing Sheets

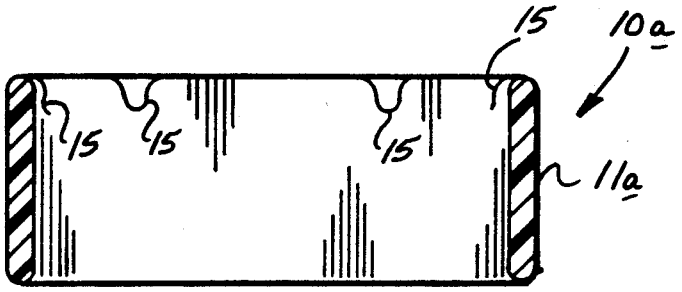
FIG 3
FIG 4
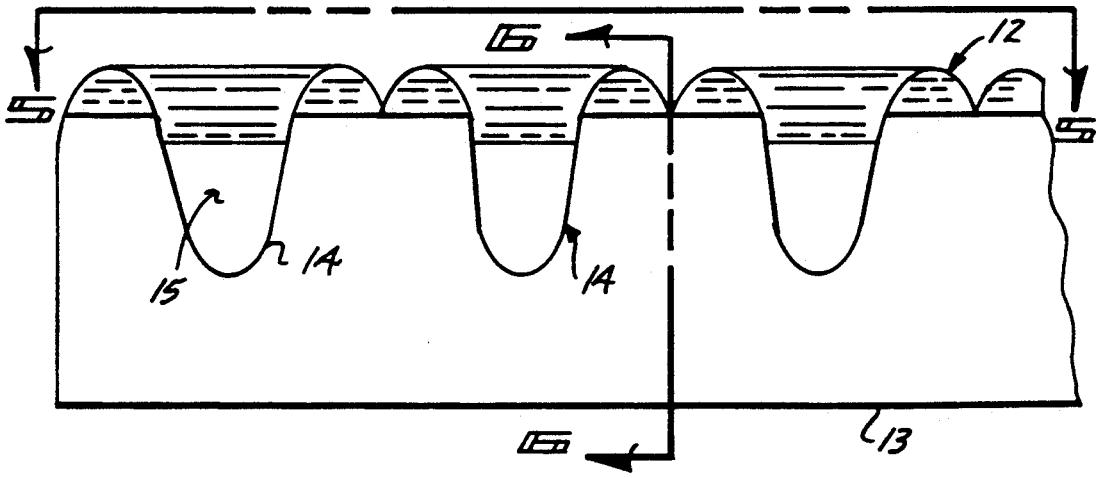

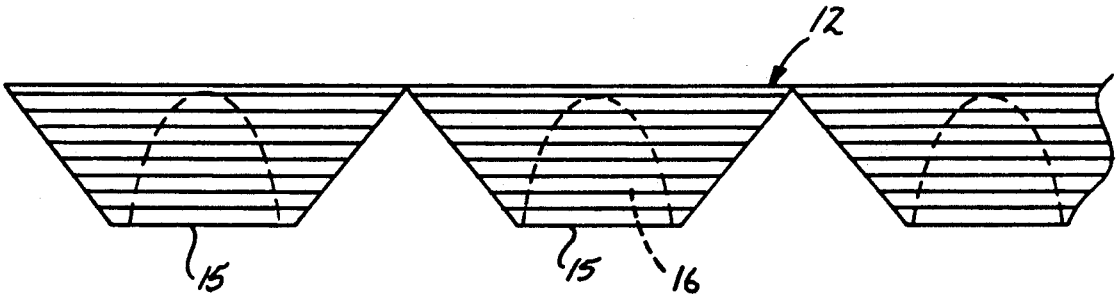
FIG 5
FIG 6
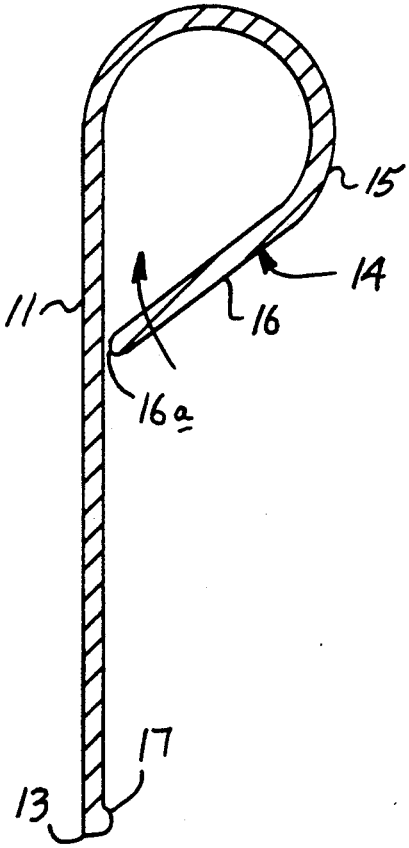

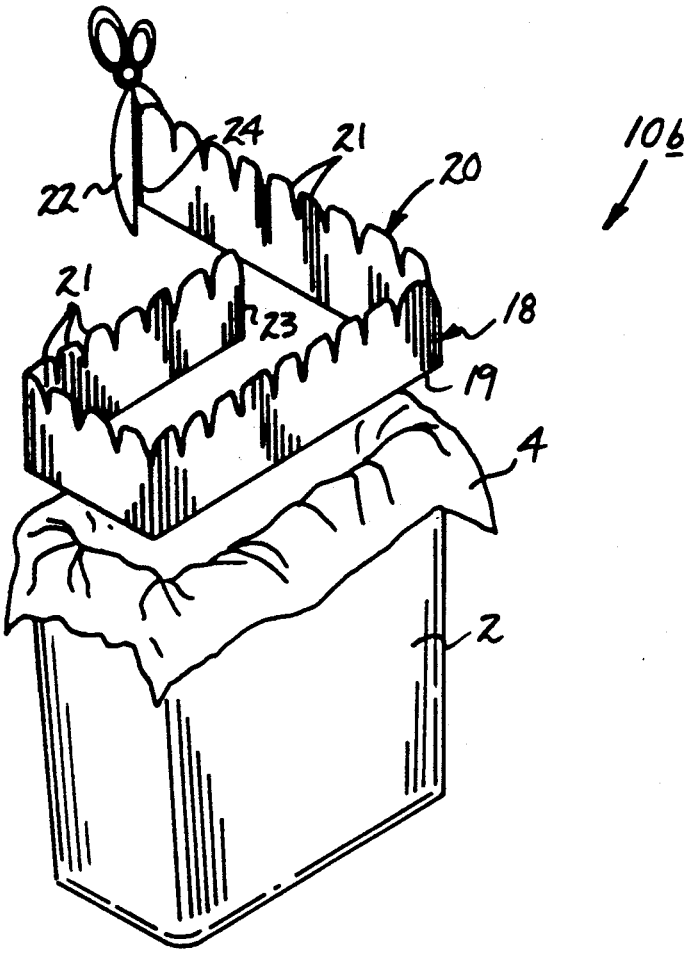
Fig 7
Fig 8
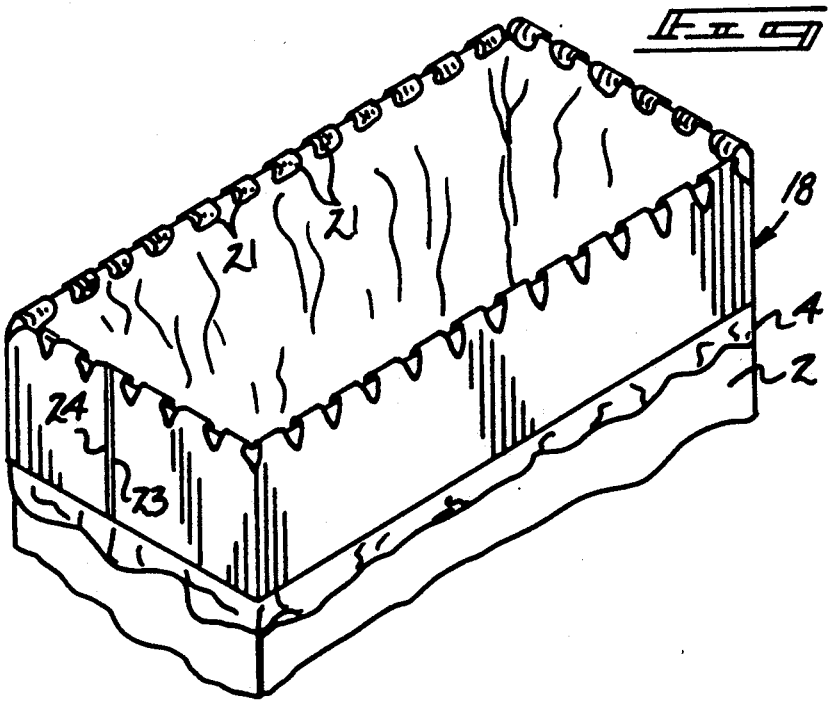

TRASH BAG SECUREMENT METHOD AND DEVICE

BACKGROUND OF THE INVENTION

1. Field of the Invention

The field of invention relates to trash bag securement devices, and more particularly pertains to a new and improved trash bag securement method and device wherein the trash bag is frictionally engaged to the device draped about an uppermost edge of an associated trash can.

2. Description of the Prior Art

Trash can liners are frequently used to contain trash directed within associated trash bags. The liners, without the use of some retention device, frequently loose their tenacity about an uppermost edge of the trash can, and are repositioned interiorly thereof requiring unnecessary attention to their repositioning about the upper edge of the trash can. Trash can devices to retain the trash can liner or bag have been provided in the prior art. Examples of such liners may be found in U.S. Pat. No. 4,715,572 to Robbins wherein a liner device includes a "U" shaped channel directed over an uppermost edge of an associated trash can to maintain the trash can liner in an overlying relationship relative to an uppermost edge of the associated trash can.

U.S. Pat. No. 4,757,966 to Harris sets forth a plastic bag or liner securement device mounted over a hoop, wherein the hoop in turn is secured between spaced legs to maintain the hoop and associated liner in an open configuration.

U.S. Pat. No. 4,488,697 to Garvey sets forth a bag holder utilizing a hoop member spaced upwardly over a support surface with an overlying clamping ring and associated "O" ring to maintain the liner within the trash can.

U.S. Pat. No. 4,765,579 to Robbins provides a two-part trash can liner retention device, wherein a first loop member is mounted over an uppermost edge of a trash can, with a second member pivotally mounted relative to the first member to retain the trash can liner within the trash can.

U.S. Pat. No. 3,916,962 to Stolt sets forth a hoop utilizing clips mounted to the hoop to retain the trash can liner within the trash can, with an associated scoop mounted upwardly over the hoop to assist in scooping material into the bag or liner.

As such, it may be appreciated that there is a continuing need for a new and improved trash bag securement method and device wherein the same addresses both the problems of ease of use and effectiveness in construction and in this respect, the present invention substantially fulfills this need.

SUMMARY OF THE INVENTION

In view of the foregoing disadvantages inherent in the known types of trash bag securement devices now present in the prior art, the present invention provides a trash bag securement method and device wherein the same enables securement of a trash bag in an overlying relationship relative to an upper edge of a trash can. The method utilizes an elongate sheet member formed with a scalloped upper edge enabling the custom fitting of the securement device to the upper edge of the trash can by overfolding fingers of the scalloped edge to secure the trash can liner within the trash can. As such, the general purpose of the present invention, which will be described subsequently in greater detail, is to provide a new and improved trash bag securement method and device which has all the advantages of the prior art trash bag securement constructions and none of the disadvantages.

To attain this, the present invention includes a continuous loop member defined by a planar body wall, with a scalloped top edge and a planar continuous bottom edge. The top edge includes downwardly depending grasping fingers formed with an arcuate upper surface and a planar lower surface. The fingers taper and narrow from the top edge to their free forward terminal end to grasp and secure a trash bag liner between an interior wall of a trash can and the free end of the fingers. The liner is preferably formed of flexible memory retentent materials.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved trash bag securement method and device which has all the advantages of the prior art trash bag securement structures and none of the disadvantages.

It is another object of the present invention to provide a new and improved trash bag securement method and device which may be easily and efficiently manufactured and marketed.

It is a further object of the present invention to provide a new and improved trash bag securement method and device which is of a durable and reliable construction.

An even further object of the present invention is to provide a new and improved trash bag securement method and device which is susceptible of a low cost of manufacture with regard to both materials and labor, and which accordingly is then susceptible of low prices of sale to the consuming public, thereby making such trash bag securement methods and devices economically available to the buying public.

Still yet another object the present invention is to provide a new and improved trash bag securement method and device which provides in the apparatuses and methods of the prior art some of the advantages thereof, while simultaneously overcomimg some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic cross-sectional view of a modification of the instant invention.

FIG. 4 is an orthographic sectional view taken in elevation of the interior surface of the continuous body wall of the instant invention.

FIG. 5 is an orthographic view taken along the lines 5—5 of FIG. 4 in the direction indicated by the arrows.

FIG. 6 is an orthographic view taken along the lines 6—6 of FIG. 4 in the direction indicated by the arrows.

FIG. 7 is an isometric illustration of a method utilized by the instant invention.

FIG. 8 is an isometric illustration of the method of utilizing the liner of the instant invention, as illustrated in FIG. 7, in a secured position with an associated trash can.

DESCRIPTION OF THE PREFERRED EMBODIMENT

Figure 1:
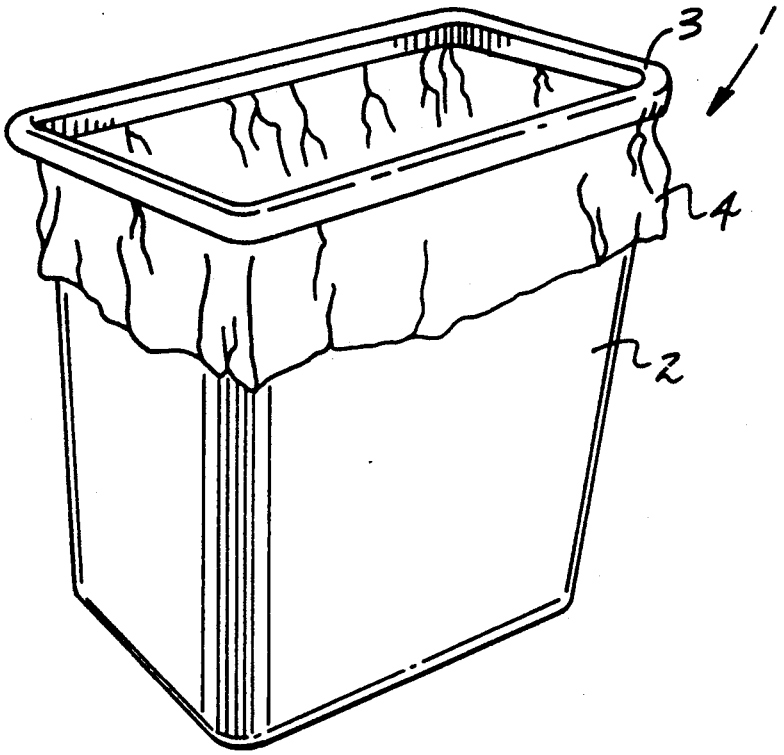
Fig 1 PRIOR ART
FIG. 1 is an isometric illustration of a prior art trash bag securement device.
Figure 2:
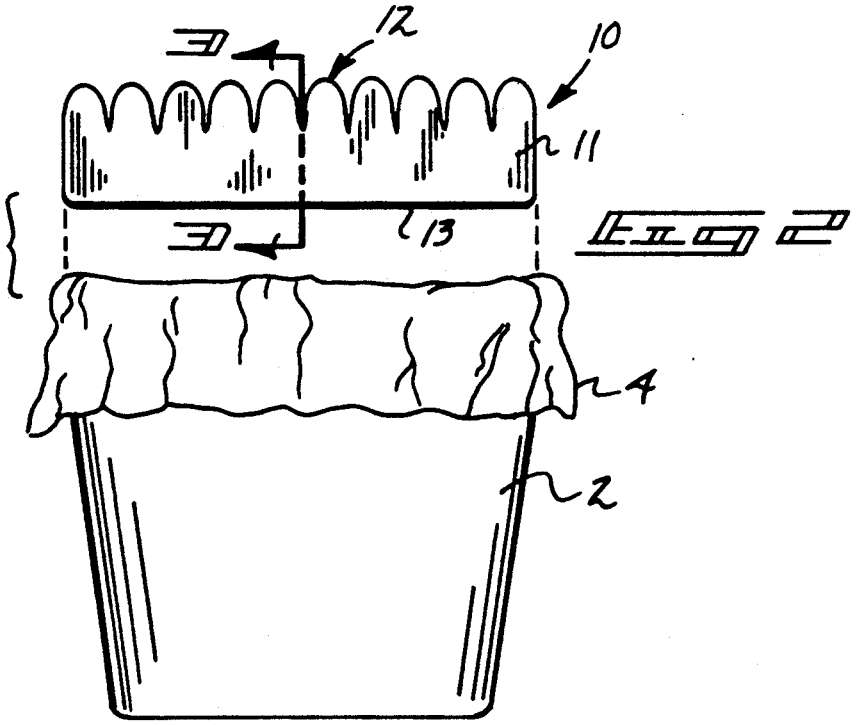
FIG. 2 is an orthographic view taken in elevation of the instant invention .

With reference now to the drawings, and in particular to FIGS. 1 to 8 thereof, a new and improved trash bag securement method and device embodying the principles and concepts of the present invention and generally designated by the reference numerals 10, 10*a*, and 10*b* will be described.

FIG. 1 is illustrative of a prior art trash can device securement means 1, wherein a liner 4 is mounted interiorly of a trash can 2, with its upper edge extending overlying the trash can edge. The device 3 includes a channel member overlying the upper edge of the trash can to secure the trash can liner in a fixed engaging position with the trash can.

More specifically, the trash bag securement method and device 10 of the instant invention includes the providing of a continuous enclosed body wall 11 defined by a generally planar surface complementary to that in direction and configuration of an upper edge of an associated trash can 2. The body wall 12 is formed with a scalloped top edge 12 and a planar bottom edge 13 spaced parallel thereto. A series of continuous, equally spaced and downwardly depending grasping fingers 14 are directed interiorly of the body wall 11. The grasping fingers 14 includes an arcuate upper surface 15, with planar lower surface portions 16, as illustrated in FIGS. 4, 5, and 6. The organization is formed of a memory retentent material, either polymeric or metallic in substance, to provide these characteristics. The fingers narrow from the top edge 12 to the forward free end of the planar lower surface portions 16. The free ends 16*a*, as illustrated in FIG. 6, are normally biased in an abutting configuration and position against the interior surface of the body wall 11. Further, an optional continuous rib 17 is formed coextensively adjacent the bottom edge 13 and extending interiorly of the body wall 11 to enhance engagement with the trash bag liner 4, wherein the rib 17 is cantilevered against the liner 4 captured between an exterior wall of the trash can 2 and the body wall 11.

FIG. 3 illustrates a modification 10*a* of the instant invention utilizing spaced clips 15 mounted at predetermined equal intervals about the body wall 11 directed interiorly thereof to capture the liner 4 between the clip 15 and the interior upper edge of an associated trash can 2.

FIGS . 7 and 8 illustrate the application of a method 10*b* utilized by the instant invention, wherein an elongate, deformable planar sheet 18 is provided formed with a linear lowermost edge 19 and a scalloped top edge 20. The sheet 18 is cut by use of a pair of shears 22 to provide a second end edge 24 spaced from a first end edge 23. The deformable sheet 18 is initially mounted adjacent an exterior upper edge of an associated trash can 2 with a liner 4 mounted therebetween, whereupon the sheet 18 is wrapped around and deformed about the upper edge surface of the trash can 2, wherein the first and second end edges formed as noted above are positioned in an abutting configuration, as illustrated in FIG. 8. Subsequently, the scalloped projections 21 are deformable and are directed interiorly of the trash can 2 and the associated sheet 18 to capture the liner 4 relative to the trash can 2.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is a follows:

1. A method of securing a trash can liner into overlying engagement with a trash can container comprising the steps of, a. inserting an elongate flexible trash can liner interiorly of an upwardly directed trash can container, and overfolding an upper trash can liner edge about an upper peripheral edge of the container, and b. providing an elongate deformable planar sheet and forming the planar sheet with a lower continuous edge and an upper planar scalloped edge spaced parallel relative to the lower continuous edge, and forming the planar sheet with at least a first end edge oriented orthogonally relative to the lower edge of the planar sheet, and c. deformably and surroundingly positioning the planar sheet about an exterior portion of the upper peripheral edge of the container, and wrapping the sheet to encompass the upper peripheral edge, and d. shearing the planar sheet to define a second edge directed orthogonally relative to the bottom edge of the planar sheet, and cutting the second edge to be positioned in abutting relationship relative to the first end edge, and e. overfolding a plurality of projections of the scalloped upper edge to overlie the upper peripheral edge of the container and clamp the liner between an interior surface of the container and a forward free end of the projections.

* * * * *